US007309188B2

(12) United States Patent
Ianniello et al.

(10) Patent No.: US 7,309,188 B2
(45) **Date of Patent: *Dec. 18, 2007**

(54) DRAINABLE BASE COURSE FOR A LANDFILL AND METHOD OF FORMING THE SAME

(75) Inventors: Peter J. Ianniello, Havre De Grace, MD (US); Aigen Zhao, Clarksville, MD (US); Gary L. Shaffer, Annapolis, MD (US)

(73) Assignee: Advanced Geotech Systems LLC, Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/931,294

(22) Filed: Sep. 1, 2004

(65) Prior Publication Data

US 2005/0158123 A1 Jul. 21, 2005

Related U.S. Application Data

(63) Continuation-in-part of application No. 10/232,811, filed on Sep. 3, 2002, now Pat. No. 6,802,669.

(51) Int. Cl.
*B09B 5/00* (2006.01)

(52) U.S. Cl. ..... 405/129.95; 405/36; 405/302.7; 210/170; 210/747

(58) Field of Classification Search ..... 405/36, 405/43, 45, 46, 50, 52, 270, 302.7, 129.95; 404/2, 3, 4, 27–31; 210/170, 747, 170.01; 428/86; 442/383, 388, 36, 57

See application file for complete search history.

(56) References Cited

U.S. PATENT DOCUMENTS

| | | | | |
|---|---|---|---|---|
| 4,397,899 | A * | 8/1983 | Marsh et al. | 428/77 |
| 4,749,306 | A * | 6/1988 | Demeny et al. | 405/45 |
| 4,815,892 | A * | 3/1989 | Martin | 405/45 |
| 4,992,003 | A * | 2/1991 | Perach | 405/302.7 |
| 5,183,355 | A * | 2/1993 | Treat et al. | 405/129.85 |
| 5,190,406 | A * | 3/1993 | Shannonhouse et al. | 405/129.6 |
| 5,735,640 | A * | 4/1998 | Meyer et al. | 405/302.7 |
| 5,823,706 | A * | 10/1998 | Hoare et al. | 404/28 |
| 5,980,155 | A * | 11/1999 | Jones et al. | 405/43 |
| 6,481,934 | B1 * | 11/2002 | Alexiew | 405/302.7 |
| 6,558,081 | B2 * | 5/2003 | Hull | 405/157 |
| 6,599,058 | B1 * | 7/2003 | Arnold | 405/129.85 |
| 6,648,549 | B1 * | 11/2003 | Urriola | 405/39 |
| 2001/0002497 | A1 * | 6/2001 | Scuero | 14/73 |
| 2003/0118404 | A1 * | 6/2003 | Lee | 405/43 |
| 2003/0199217 | A1 * | 10/2003 | Cashin et al. | 442/394 |
| 2003/0215287 | A1 * | 11/2003 | Prevost | 404/71 |
| 2003/0223826 | A1 * | 12/2003 | Ianniello | 405/302.4 |
| 2004/0022583 | A1 * | 2/2004 | Bussey et al. | 405/43 |

* cited by examiner

*Primary Examiner*—Tara L. Mayo
(74) *Attorney, Agent, or Firm*—The Nath Law Group; Jerald L. Meyer; Matthew J. Moffa

(57) ABSTRACT

Numerous embodiments of one or more layers of void-maintaining synthetic drainable base courses ("VMSD-BC's") are provided as incorporated into landfills and other waste containment facilities.

75 Claims, 6 Drawing Sheets

DRAINABLE BASE COURSE FOR A LANDFILL AND METHOD OF FORMING THE SAME

RELATED APPLICATIONS

The present application is a Continuation-In-Part of U.S. patent application Ser. No. 10/232,811, filed Sep. 3, 2002, now U.S. Pat. No. 6,802,669, granted Oct. 12, 2004. The present application also claims priority to U.S. patent application Ser. No. 09/501,324, filed Feb. 10, 2000, now U.S. Pat. No. 6,505,996, granted Jan. 14, 2003; to U.S. patent application Ser. No. 09/501,318, filed Feb. 10, 2000 (now abandoned); and U.S. Provisional Application No. 60/316,036, filed Aug. 31, 2001. The cited Applications are hereby incorporated by reference in their entireties.

FIELD OF THE INVENTION

The present invention pertains to means and methods for controlling the flow of fluids, such as gases and aqueous liquids through, and for evacuating fluids from, landfills and other large structures. The invention provides improved and novel drainage elements and systems of geosynthetic void-maintaining synthetic drainable base courses ("SDBC") which can be installed economically as substitutes for all or portions of conventional drainage components and systems.

BACKGROUND OF THE INVENTION

Leachate, an aqueous solution created by the passage of fluids through waste piles, is a principal environmental concern. Since passage of the Clean Water Act, waste containment systems must be engineered to prevent migration of leachate into the groundwater underlying landfill sites. Conventionally, the containment and flow control of such leachate has been achieved by the use of one or more of compacted clay liners, various types of synthetic geomembranes, and synthetic clay liners.

It is well established that leachate can cause distress and damage to synthetic liner systems, causing leaks, and thereby polluting groundwater and the local environment. Therefore, the effective engineering and design of a containment system for a landfill or other similar structure requires drainage systems to be constructed above geomembrane liners which are disposed to remove these fluids. In fact, the USEPA regulatory guidance states that no more then a one-foot liquid head is allowable above a geomembrane in such an installation. In some conventional drainage systems, engineers specify that stone of uniform gradation be utilized as the leachate drainage layer at the base of a landfill. Stones are often specified to obtain a certain "diameter" and are measured in sieves that have specific diameters. This is because spheres touch at points of tangentiality. In some other drainage systems, engineers specify that processed tire chip aggregate of uniform sizes be utilized as the leachate drainage layer at the base of a landfill. Engineers skilled in the art of landfill design utilize the principle of tangentiality and require aggregate producers to manufacture stone particles that are relatively spherical. They achieve this by specifying uniform gradations of stone. A gradation refers to the distribution of stones with different "diameters."

Thus, leachate collection systems are highly engineered layered structures and require engineered materials that are selected based upon factors such as their density, particle or aggregate size, compressibility, chemical compatibility, and other engineering parameters of the soil, stone and aggregate-based products.

Stone is highly non-compressible. Therefore, even when stones are subjected to compressive forces, voids exist in those spaces where the stones do not touch. Therefore, even under significant loading conditions, void spaces, or porosity may be obtained. The more open void space volume created, the greater the porosity. Typically, the more porous an installation or layer, the higher the resulting cost. For example, a stone with an effective size of ¼" and a coefficient of uniformity of 2.5, typically costs much more then sand. This type of gradation is often classified as AASHTO 57 and is often utilized to create open-graded base course in landfills, roadways, and other installations needing a specified drainage capacity. Aggregate classifications are standardized for FHWA and DOT Transportation applications. In contrast, this degree of classification typically does not exist for environmental markets. For example, while a landfill in California may specify a stone of uniform gradation of average ½", such specifications may not refer to the stone as an AASHTO 57 stone. This is so even though the transportation department or company that constructed the road to the landfill may have utilized the same exact stone and classified it as AASHTO 57. AASHTO 57 is often used as an open-graded base course (OGBC).

An open graded base course (OGBC) can be utilized as a means to convey fluids to leachate collection laterals and pipes. Still, in other systems engineers will specify sand as a natural material that offers both vertical permeability and horizontal transmissivity. As one skilled in the art of landfill design can appreciate, not all landfills require sand nor do they all require stone. Therefore, design of particular landfills is often site-specific. For example, engineers may require a stone drainage layer to achieve the regulatory requirements but the local geological conditions do not offer stone. When this occurs, contractors are required to purchase stone and have it transported over long distances. Such transportation costs significantly drives up the cost of construction of the landfill. In fact, engineers and other design personnel who procure construction aggregates typically estimate that the cost of aggregate supply doubles for every 25 miles of transport distance to the landfill site.

In conventional landfill construction, an OGBC may be placed to form a leachate collection system. These OGBC systems are typically used above primary geomembranes. Leachate collection systems are highly engineered layered structures and require engineered materials that are selected based upon factors such as their density, particle or aggregate size, compressibility, chemical compatibility, or other engineering parameters of the soil, stone and aggregate-based products.

Other engineering parameters reflect the importance of sufficient drainage in landfills. In fact, bioreactors and/or leachate recalculation facilities require high flowing materials. For example, theses types of structures collect all leachate and recirculate the fluids to help further consolidate the waste mass. This re-circulation results in increased void or air-space which results in more capacity and, consequently, more potential revenue for a site. Thus, the rate at which leachate and other fluids are transported away from the various layers of a landfill is a critical element in its useful life. Leakage rates that are excessive require the landfill to be closed and the leak to be corrected. Thus, inadequate drainage can be an extremely serious and costly problem affecting a landfill.

In one conventional method of approaching these drainage problems, an OGBC drainable layer formed of natural stone and aggregate materials is included above or beneath a geomembrane in an attempt to positively control fluids and dissipate pore pressures which commonly accumulate within these structures. Typically, an OGBC-drainable permeable layer also utilizes a geotextile for membrane protection and/or filtration. An OGBC is intended to be a porous drainage media that is capable of receiving fluids from the points of entry and then transporting them to designated discharge points in a timely manner. These systems often utilize AASHTO 57 stone. According to the FHWA, an AASHTO 57 stone has a permeability of 6,800 linear feet per day and any OGBC drainage layer should have a minimum permeability of 1,000 linear feet per day.

An OGBC is typically produced from stone that has been mined from quarries. A main distinguishing characteristic of OGBC materials is that they are usually delivered to work sites having a fairly uniform gradation per the specifications of the project engineer. Typically, project engineers use published standards for OGBC available from AASHTO, the Federal Highway Administration, or their resident state's department of transportation. Theoretically, the uniform gradation of OGBC materials typically creates voids of desired and predictable dimension between the pieces of stone when they are in place. Thus, desired flow rates through both vertical and horizontal planes of the OGBC can be increased or decreased somewhat predictably by selecting appropriate size distributions of the stone particulate material.

An OGBC can be costly to install and maintain, and can be difficult to control and predict with respect to quality. Although such gradations of stone typically create interconnecting void spaces or holes among and between the aggregate useful to facilitate the reception and transmission of fluid, an OGBC can take up a considerable volume of valuable space of the installation. An additional problem relates to the longevity of the chosen stone. Stone is made of different minerals, some of which minerals are soluble in water or in the harsh chemical environments which often exist in landfills. In fact, in Kentucky, certain OGBC leachate collection systems constructed of limestone have completely dissolved because of the chemical nature of the fluids passing through them.

Other disadvantages of OGBC's pertain to the additional elements that are required in an OGBC installation. Typically, a well graded granular or geotextile filter layer is needed above the OGBC in order to prevent contamination of the OGBC from the migration of fines. This extra filter layer further increases the construction costs of the landfill. Yet another problem with the use of OGBC's is that aggregate of sufficient quality is not always available or, if available, it's cost is uneconomical or prohibitively high. There is therefore a need for landfills and for landfill drainage systems that utilize components which can be engineered and manufactured offsite, and easily transported to the site and integrated economically into the landfill or other large structure, and to provide equivalent or superior flow to that of a conventional OGBC. There is a similar need for drainage elements suitable for integration into landfills and other large structures which take up much less space than conventional OGBC's.

The present geosynthetic drainage elements offer a solution to these problems. In general, geosynthetics are manufactured from polymeric materials, typically by extrusion, as substantially planar, sheet-like, or cuspidated products. Geosynthetics are usually made in large scale, e.g., several meters in width and many meters in length, so that they are easily adaptable to large-scale construction and landscaping uses. Many geosynthetics are formed to initially have a substantially planar configuration. Some geosynthetics, even though they are initially planar, are flexible or fabric-like and therefore conform easily to uneven or rolling surfaces. Some geosynthetics are manufactured to be less flexible, but to possess great tensile strength and resistance to stretching or great resistance to compression. Certain types of geosynthetic materials are used to reinforce large manmade structures, particularly those made of earthen materials such as gravel, sand and soil. In such uses, one purpose of the geosynthetic is to hold the earthen components together by providing a latticework or meshwork whose elements have a high resistance to stretching. By positioning a particular geosynthetic integral to gravel, sand and soil, that is with the gravel, sand and soil resident within the interstices of the geosynthetic, unwanted movement of the earthen components is minimized or eliminated.

Most geosynthetic materials, whether of the latticework type or of the fabric type, allow water to pass through them to some extent and thus into or through the material within which the geosynthetic is integrally positioned. Thus, geosynthetic materials and related geotechnical engineering materials are used as integral parts of manmade structures or systems in order to stabilize their salient dimensions.

Before the present invention, the only geosynthetic materials available for landfill drainage were exclusively limited to drains at the edge or shoulder of a landfill. These edge-drain systems are commonly located within a covered trench originally dug along the shoulder of the landfill. Conventional edge drain geosynthetics, however, cannot withstand the repeated dynamic loads that are present directly beneath heavy overburdens, such as those typically found in land fills and other large structures. Geosynthetic drainage materials have been utilized also on side slopes of landfills in order to ameliorate stability difficulties associated with construction of granular material drains. Geosynthetic drainage materials of dimensions up to 275 mils thick have been utilized to complement sand or to substitute for sand as a natural material at the floor of landfill. However, such geosynthetic products have never been engineered to achieve flow rates and void-maintaining capabilities sufficient to replace stone. The present invention relates generally to synthetic void-maintaining structures with high permittivity and high transmissivity that are capable of partially or fully replacing stone in landfills and other large structures by maintaining voids of sufficient dimensions to permit the timely egress of undesirable fluids.

The present invention provides a series of Void-Maintaining Synthetic Drainable Base Courses ("VMSDBC's") of polymeric material, and related methods, for designing and constructing leachate collection systems and drainage systems. The present VMSDBC's and methods thereby eliminate or minimize the amount of conventional open-graded stone that might otherwise be required. Until the present invention, no geosynthetic material had been designed or implemented that could provide a drainage system of equivalent or superior drainage to those of an OGBC as utilized to convey fluids in a conventional landfill. Similarly, until the present invention, no geosynthetic material had ever been designed that could maintain voids of defined and sufficient dimensions while undergoing the repeated dynamic cycles of fluid infiltration and exposure demanded of bioreactors and re-circulation facilities.

The present VMSDBC void-maintaining system is the first such synthetic material that allows those skilled in the art of landfill design to replace stone. Water migrates and enters the VMSDBC system and then travels through the VMSDBC to locations or areas where the fluid is then conveyed for discharge in a timely manner in designated areas of a landfill, or outside of it. The present invention thus offers a synthetic product that overcomes the many deficiencies of the conventional OGBC.

Thus, the present invention relates generally to synthetic void-maintaining structures with high permittivity and high transmissivity that are capable of extending the life of a landfill. The present invention thus overcomes stability concerns of other geosynthetics which are not truly suitable for use as void-maintaining drainage structures in landfills and other large structures. Numerous embodiments of the present VMSDBC and methods overcome the disadvantages of the conventional OGBC systems by providing a plurality of interconnected voids of great mechanical and dimensional stability while simultaneously providing sufficient horizontal flow to perform in accordance with "Good to Excellent" drainage performance when assessed with respect to AASHTO definitions. These performance attributes are unique to the present VMSDBC drainage elements and landfills, which eliminate many of the problems associated with fluids underlying large structures that are not resolved by conventional OGBC systems or any conventional geosynthetic product. By eliminating these problems, VMSDBC's of the present invention extend the useful life of the landfill by increasing the effective amount of airspace.

In accordance with other aspects of the present invention, the VMSDBC's of the invention can be positioned in a landfill to maximize their effectiveness. For example, a VMSDBC can be positioned directly above a geomembrane or beneath a geomembrane. Moreover, a VMSDBC of the invention can be made in large pieces, for example, in pieces several meters wide and many meters long. For convenience and installation, however, a VMSDBC and its components may be installed in portions which are interconnected such that the interconnecting voids are of sufficient dimension that the leachate can move freely through the SDBC and be connected to drain means such as a perforated pipe, drainage ditch, or culvert adjacent to the landfill.

In an important aspect, VMSDBC's of the invention, maintain the preferred void dimensions even under substantial loads. For example, typically the lower surface of the super stratum, that is, the upper fluid-transmissible layer, and the upper surface of the substratum, that is, the lower fluid-transmissible layer, are prevented from having contact with one another when the upper surface of the substratum and the lower surface of the super stratum are placed under sustained loads above 10,000 psf and the lower surface of the substratum and upper surface of the super stratum are in contact with a soil environment for a duration of not less than 100 hours.

Other advantages of the present VMSDBC's can be seen with respect to their fluid-transmitting capacity. For example, in some embodiments, a VMSDBC of the present invention typically exhibits a fluid transmitting capacity of at least 4,000 $ft.^3$/day/ft when tested under a normal load of 15,000 psf, and at a gradient of 2% per ASTM D 4716. Thus, the present VMSDBC's exhibit superior fluid-transmitting characteristics and meet the specifications for classification as "Excellent to Good" performance under AASHTO's definitions.

Advantageously, a VMSDBC according to the present invention is superior to conventional drainage elements, inter alia, because it is capable of resisting long-term compressive stress to the extent that it resists creep deformation and structural catastrophic collapse under load by retaining 60% of its external dimensional thickness after 10,000 hours under a sustained normal load of 10,000 pounds per square foot. Preferably, a VMSDBC according to the invention, comprises an upper fluid-transmissible surface, and the core is pervious to the vertical migration of fluids. Furthermore SDBCs are preferably constructed and arranged to transmit fluids to discharge points within or at the perimeter of a landfill whereby the piping or other collection means is designed to receive fluids transported from within the landfill by means of the SDBC.

Void-maintaining synthetic drainable base courses ("VMSDBC's") of the present invention can be fabricated into panels of various lengths and widths by using conventional means to weld, adhere, tie or sew SDBC sections to one another to form a continuous SDBC underneath construction soils, landfill materials, or waste.

SUMMARY OF THE INVENTION

It is therefore an object of the present invention to provide economical means and methods for providing drainage to landfills and other large structures.

It is also an object of the invention to provide void-maintaining synthetic drainable base courses that may be used in place of stone and other forms of open graded base courses in landfills and other large structures.

It is a further object of the invention to provide synthetic drainable base course elements that may be positioned in landfills with the use of conventional earth-moving and similar equipment.

In accordance with these and other objects of the invention, a series of landfills are provided having synthetic drainable base courses for controlling the flow of fluids such as liquids and gases within landfills and other large structures, and for draining landfills and other large structures, are provided. In one preferred embodiment, a landfill or other large structure according to the invention preferably comprises a base layer formed at least partially of one or more of native soil components and non-native soil components, a synthetic drainable base course element disposed above the base layer, wherein the drainable base course element comprises a void-maintaining geocomposite, the geocomposite including a geocomposite core element having a plurality of ribs constructed and arranged to form a plurality of interconnected voids, the core element having an upper surface and a lower surface, a no-load thickness and a thickness under load, wherein the thicknesses are measured substantially perpendicular to the surfaces, and at least one fluid-transmissible layer attached adjacent the upper surface, wherein the layers and the core element are constructed and arranged so that, under a load of at least 500 lbs/$foot^2$ for a period of at least 100 hours, the geocomposite maintains voids of sufficient dimension that fluid from the landfill or other large structure can move freely through portions of the drainage element at a transmissivity of at least 19 gallons/minute/foot at a slope gradient of 33% and at least 33 gallons/minute at a slope gradient of 10%, and, above the synthetic drainable base course, fill suitable to be drained, the fill comprising one or more layers, sections or quantities of refuse materials, or materials to be processed at least partially within the landfill, wherein at least a portion of the synthetic drainable base course is sloped downwardly in a gradient from a first portion to a second portion of the landfill or other large structure.

Advantageously, a drainable landfill or other large structure of the invention include wherein the layers and the core element are constructed and arranged so that, under a load of at least 1,000 lbs/$foot^2$ for a period of at least 100 hours, the geocomposite maintains voids of sufficient dimension that fluid from the landfill or other large structure can move freely through portions of the drainage element at a transmissivity of at least 19 gallons/minute/foot at a slope gradient of 33% and at least 33 gallons/minute at a slope gradient of 10%. In other preferred embodiments, other capacities are achieved. For example, in one preferred embodiment the layers and the core element are constructed and arranged so that, under a load of at least 15,000 lbs/foot$^2$ for a period of at least 100 hours, the geocomposite maintains voids of sufficient dimension that fluid from the landfill or other large structure can move freely through portions of the drainage element at a transmissivity of at least 8.5 gallons/minute/foot at a slope gradient of 10%. In still other preferred embodiments, the layers and the core element are constructed and arranged so that, under a load of at least 25,000 lbs/foot$^2$ for a period of at least 100 hours, the geocomposite maintains voids of sufficient dimension that fluid from the landfill or other large structure can move freely through portions of the drainage element at a transmissivity of at least 3.5 gallons/minute/foot at a slope gradient of 10%.

In accordance with additional objects of the invention, the geocomposite core element preferably comprises a plurality ribs constructed and arranged in one or more of uniplanar, bi-planar, and triplanar configurations. Numerous permutations of such layers of ribs are possible within the scope of the present invention. For example, in one preferred embodiment, the ribs of the core are provided in a first set and a second set, and the ribs of the first set are disposed substantially parallel to one another and substantially in a first plane, and the ribs of the second set being disposed substantially parallel to one another and substantially in a second plane, and wherein the first and second planes are disposed adjacent one another. Thus, ribs of the respective adjacent layers may cross one another at an angle of between 90 degrees and 20 degrees. In other preferred embodiments, further ribs are provided in at least a third set wherein the ribs of the third set are disposed substantially parallel to one another and the third set of ribs is disposed in a third plane adjacent and non-parallel to the ribs of the first or second sets.

As a further advantage, ribs of the geocomposite can be provided in whatever numerous cross-sectional shape and length variations which are necessary to achieve the drainage capacities of a particular landfill or other large structure, such as an airport runway, a runway runoff zone, a parking lot, a temporary runway, a building, or a buried antenna site. Included in such cross-sectional shapes are those where the ribs approximate one or more shapes from the group consisting of squares, rectangles, ovals, star shapes, crenulations, and trapezoids. Dimensions of the ribs can be tailored to provide desired capacities, economies, and installation characteristics.

For example, in one preferred embodiment, a square rib of a geocomposite according to the invention has a width and a height approximately equal to one another, and the width and height have dimensions of from 1.0 to 10.0 mm. In other preferred embodiments, a rectangular rib of the invention has a width and a height, and the width has dimensions of from 2.0 to 15.0 mm and the height has dimensions of from 1.0 to 10.0 mm. In still other preferred embodiments, a trapezoid-shaped rib of the invention has a major width, a minor width and a height, and the major width has dimensions of from 2.0 to 15.0 mm, the minor width has dimensions of from 1.0 to 10.0 mm and the height has dimensions of from 1.0 to 10.0 mm.

The ribbed layers of a geocomposite of the invention can be provided in shapes and forms which take advantage of conventional plastic extruders known to the industry, and of the various extrusion methods known for plastics in order to produce geocomposite core elements for use with the invention. For example, in some embodiments of core element ribs of the invention, at some or all of the ribs comprise crenulations and the crenulations are disposed either longitudinally along the surfaces of the ribs or cross-wise along the rib surfaces.

Landfills of the inventions include those where the non-native soil components of the base are one or more selected from the group consisting of refuse from highway excavations, refuse from building foundation excavations, mining refuse, manufacturing refuse, geologic refuse, gypsum refuse, quarry refuse, refuse from road-building activities, and refuse from dredging operations.

In order to provide for desired drainage characteristics, the base layer of the drainable structure comprises at least one, or a plurality of, slopes or sloping surfaces. In some preferred embodiments, such sloping surfaces form at least one, or a plurality of containers. The containers can be separate from one another or can be interconnected. For instance, a plurality of containers according to the invention can be constructed and arranged such that at least portions of one container can drain via gravitational means into one or more of other containers of the plurality of containers. Thus, in some facilities, some containers can drain into other containers by gravitation means. As yet another advantage, the drainage element may further comprise at least one frictional layer attached adjacent the lower surface of the geocomposite, or at least one cushion layer adjacent the lower surface of the geocomposite.

In some preferred embodiments, the drainable landfill or other large structure of the invention is layered. Preferably, the slope gradient is at least 1% in a direction away from the portion of the landfill to be drained, and more preferably is at least 2% or 3% but can be as high as 40%. Also preferably, the portion of the landfill to be drained includes the centerline.

Other significant aspects of the present invention relate to the capacities and conditions under which those capacities can be attained. Examples of these capacities and conditions include those where the synthetic drainable base course element, under a normal load of 1,200 kPa for at least 10,000 hours at 20 degrees Celsius, maintains its thickness under load of at least 65% of its no-load thickness, and those where, under a normal load of 720 kPa for at least 5,000 hours at 40 degrees Celsius, the thickness under load is maintained to at least 50% of the no-load thickness. Additional capacities include those wherein, under a normal load of 1,200 kPa for at least 10,000 hours at 20 degrees Celsius, the thickness under load is maintained at least 60% of the no-load thickness, or at least 50% of the no-load thickness, at least 45% of the no-load thickness, or at least 40% of the no-load thickness. Yet other advantageous capacities include those wherein, under a normal load of 720 kPa for at least 5,000 hours at 40 degrees Celsius, the thickness under load is maintained at least 65% of the no-load thickness, or at least 60% of the no-load thickness, at least 45% of the no-load thickness, or at least 40% of the no-load thickness.

Landfills and base course elements of the present invention include also those embodiments that are resistance to shear forces in situ. For instance, the invention includes landfills and synthetic drainable base course drainage elements which, under a normal load of 720 kPa and a shear load of 240 kPa for at least 5,000 hours at 40 degrees Celsius, maintain the thickness of the geocomposite under load of at least 50% of its no-load thickness. Other capacities include those wherein, under a normal load of 720 kPa and a shear load of 240 kPa for at least 5,000 hours at 40 degrees Celsius, the thickness under load remains at least 45% of the no-load thickness of the geocomposite, and embodiments wherein, under a normal load of 720 kPa and a shear load of 240 kPa for at least 5,000 hours at 40 degrees Celsius, the thickness under load is at least 40% of the no-load thickness. Typical no-load thicknesses of base course drainage elements of the invention include those wherein the no-load thickness is in the range of from 0.20 inches to 1.00 inches, or in the range of from 0.20 inches to 0.75 inches, or in the range of from 0.25 inches to 0.35 inches. Preferably, a core element has a tensile strength of at least 400 lbs per foot in the machine direction and, more preferably, of at least 500 lbs per foot in the machine direction.

Another parameter for measuring the capacities and performance of the present base courses pertains to the size and capacities of voids that are maintained under a particular load for a particular period of time. In general, a void is any space created near the intersection of at least two ribs, or the intersection between at least one rib and the fabric overlying it, or underlying it. The width and height of such voids can be considered together or as independent dimensions to be measured. For example, embodiments of the invention are provided wherein, under a load of 720 kPa for at least 100 hours, the voids of the base course maintain an average width of at least 2.0 mm and an average height of at least 10.0 mm, and the voids maintain an average width of from 2.0 mm to 10.0 mm. In other embodiments, under a load of 720 kPa for at least 100 hours, the voids maintain an average width of from 3.0 mm to 8.0 mm.

In still other embodiments under higher pressures, for instance, in a synthetic drainable base course of the invention under a load of 1,200 kPa for at least 100 hours, or at least 1,000 hours, the voids maintain an average width of from 2.0 mm to 10.0 mm and an average height of from 3.0 mm to 8.0 mm, or an average width of from 2.0 mm to 10.0 mm, an average height of from 3.0 mm to 8.0 mm, an average width of at least 2.0 mm and an average height of at least 8.0 mm, an average width of at least 2.0 mm and an average height of at least 8.0 mm.

In yet additional embodiments, the synthetic drainable base course element of the invention, under a load of 720 kPa for at least 100 hours, or for at least 1,000 hours, the voids maintain an average width of at least 3.0 mm and an average height of at least 10.0 mm, or an average width of at least 6.0 mm and an average height of at least 8.0 mm.

Advantageously, the ribs of the present synthetic drainable base courses can be constructed and arranged to form preferential flow paths and non-preferential flow paths in sloped or non-sloped portions of the landfill. Preferably, the preferential flow paths and the non-preferential flow paths are not parallel to one another. Flow paths of the invention are formed by the relative placement of the rib elements and are advantageous in that they direct the flow of water or other fluids in a preferred direction. In some embodiments of drainage elements and landfills of the invention, they are disposed in the landfill such that the preferential flow path is substantially perpendicular to a portion of the landfill such as the centerline or axis. In such a configuration, the shortest flow path distance between the centerline and an area, sump, or margin of the landfill is achieved. In other embodiments, the preferential flow path is substantially parallel to the slope of the portion of the landfill so that fluids flow in the most direct path to a desired point or area.

Preferably, the proportion of fluid that follows by way of preferential pathways is at least 35% of the volume of fluid moving through any given portion of the drainage element, or at least 50% or at least 65%. In some embodiments, the core or the core along with the overlying and underlying geomembrane layers, includes at least one margin constructed and arranged to transmit fluids from the synthetic base course away from the landfill or other large structure. The margin can be at the side of the landfill or other large structure, and preferably is constructed and arranged to connect with other means for carrying the drained fluid away such as perforated pipes, non-perforated pipes, drainage ditches, sumps, canals, re-circulating manifolds, drainage manifolds and other facilities for further processing of the leachate and of the waste.

In accordance with additional advantageous aspects, the present invention provides a method of forming drainable landfill or other large structure, the method comprising the steps of A) providing a base layer formed at least partially of one or more of native soil components and non-native soil components, B) providing a synthetic drainable base course element disposed above the base layer, the drainage element comprising a void-maintaining geocomposite, the geocomposite including a geocomposite core element having a plurality of ribs constructed and arranged to form a plurality of interconnected voids, the core element having an upper surface and a lower surface, a no-load thickness and a thickness under load, wherein the thicknesses are measured substantially perpendicular to the surfaces, and at least one fluid-transmissible layer attached adjacent the upper surface, wherein the layers and the core element are constructed and arranged so that, under a load of at least 500 lbs/foot$^2$ for a period of at least 100 hours, the geocomposite maintains voids of sufficient dimension that fluid from the landfill or other large structure can move freely through portions of the drainage element at a transmissivity of at least 19 gallons/minute/foot at a slope gradient of 33% and at least 33 gallons/minute at a slope gradient of 10%, and C) providing above the synthetic drainable base course, fill suitable to be drained, the fill comprising one or more layers, sections or quantities of refuse materials, or materials to be processed at least partially within the landfill, wherein at least a portion of the synthetic drainable base course is sloped downwardly in a gradient from a first portion to a second portion of the landfill or other large structure. Methods of the invention incorporate the materials, elements and capacities disclosed herein, and are adaptable to many different applications.

The invention includes also a number of synthetic drainable base course composite elements suitable for providing drainage when positioned within a landfill or other large structure, each of the base course element comprising a void-maintaining geocomposite, the geocomposite including a) a geocomposite core element having a plurality of ribs constructed and arranged to form a plurality of interconnected voids, the core element having an upper surface and a lower surface, a no-load thickness and a thickness under load, wherein the thicknesses are measured substantially perpendicular to the surfaces, and b) at least one fluid-transmissible layer attached adjacent the upper surface, wherein the layers and the core element are constructed and arranged so that, under a load of at least 1,000 lbs/foot$^2$ for a period of at least 100 hours, the geocomposite maintains voids of sufficient dimension that fluid from the landfill or other large structure can move freely through portions of the drainage element at a transmissivity of at least 19 gallons/minute/foot at a slope gradient of 33% and at least 33 gallons/minute at a slope gradient of 10%, and wherein the geocomposite is constructed and arranged so that the transmissivity is maintained within the landfill or other large structure when, fill comprising one or more layers, sections or quantities of waste or refuse materials, or waste or materials to be processed at least partially within the landfill, is disposed above the geocomposite, wherein at least a portion of the synthetic drainable base course is sloped downwardly in a gradient from a first portion to a second portion of the landfill or other large structure.

BRIEF DESCRIPTIONS OF THE FIGURES

FIG. 1(*b*) shows an idealized cross-section of a municipal solid waste system according to the present invention including a void-maintaining geocomposite/geomembrane layer.

FIG. 2(*b*) shows an idealized cross-section of a hazardous waste landfill minimum liner system of the present invention including primary and secondary geocomposite/geomembrane liners.

FIG. 3(*b*) shows an idealized cross-section of a typical landfill cover system of the present invention including geocomposite elements for drainage and void-maintaining geocomposite elements for gas venting.

DETAILED DESCRIPTION OF EXEMPLARY EMBODIMENTS OF THE INVENTION AND OF CONVENTIONAL DESIGNS

The present invention may be understood with respect to the following figures which are exemplary and not exclusive. As one of skill in the arts will appreciate, numerous embodiments of the present invention are within the scope and spirit of the present disclosure.

Figure 1A:
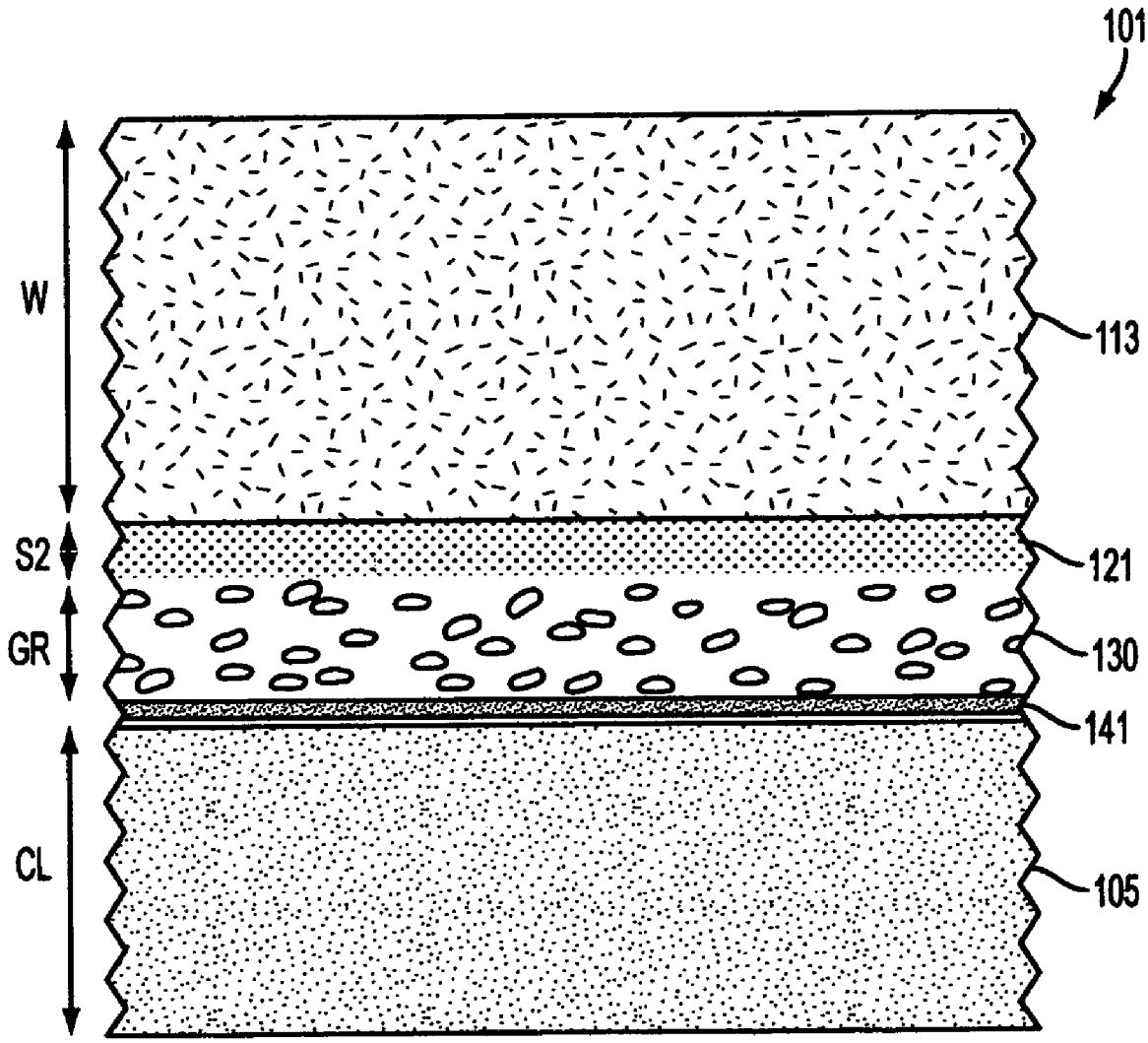
FIG. 1(*a*) shows an idealized cross-section of a conventional design of a municipal solid waste system with a conventional minimum liner system.
Figure 1B:
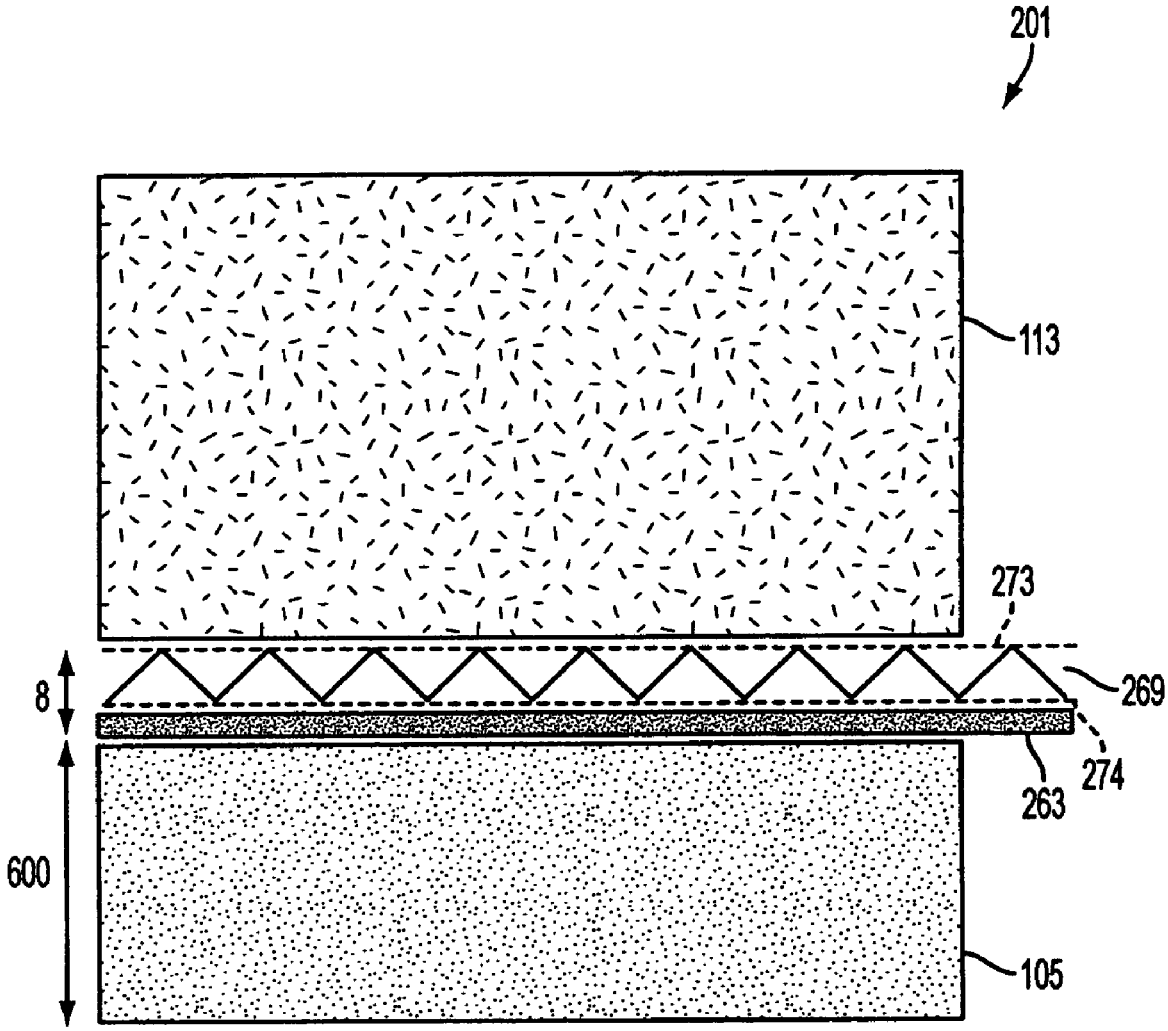

FIG. 1(*a*) shows an idealized cross-section of a conventional design of a municipal solid waste system with conventional minimum liner system. With reference to FIG. 1(*a*), municipal solid waste system 101 comprises clay liner or base 105, of thickness CL, which is typically a minimum of 600 millimeters ("mm"). Base 105 is topped by conventional geomembrane 141. In turn, conventional geomembrane 141 is covered with gravel layer 130, of thickness GR, typically a minimum of 300 mm. Gravel layer 130 is covered with conventional sand layer 121, of thickness S, typically a minimum of 150 millimeters. Sand layer 121 is covered with waste overburden 113, of thickness W, and typically from several meters to several dozens of meters in thickness. A conventional completed solid waste system typically includes a capping structure, such as that shown in FIG. 3(*a*).

FIG. 1(*b*) shows an idealized cross-section of a municipal solid waste system according to the present invention including a void-maintaining geocomposite/geomembrane layer. A municipal solid waste system exemplary of the present invention includes system 201 as shown in FIG. 1(*b*), where clay liner or base 105, of thickness CL2, and typically from 300 millimeters to 1,000 millimeters in thickness. Clay liner 105 is covered with geomembrane 263 and void-maintaining geocomposite 269. In total, the combined thickness of geomembrane 263 and void-maintaining geocomposite 269 is typically less than two inches, and more preferably, less than one inch. Geocomposite layer 269 is provided with upper geotextile filter layer 273 preferably attached to layer 269 at a plurality of attachment points or areas (not shown) and, on the lower, or bottom, surface of layer 269, geocomposite contacting elements (not shown) disposed on top of, or adjacent to, geomembrane 263. Interposed between geomembrane 263 and geocomposite layer 269 is optional layer 274, which can be a friction layer or a cushion layer, for example. Waste overburden 113, of thickness W, and typically several meters to several dozen meters in thickness, is shown on top of geocomposite/geotextile layer 269/273.

Figure 2A:
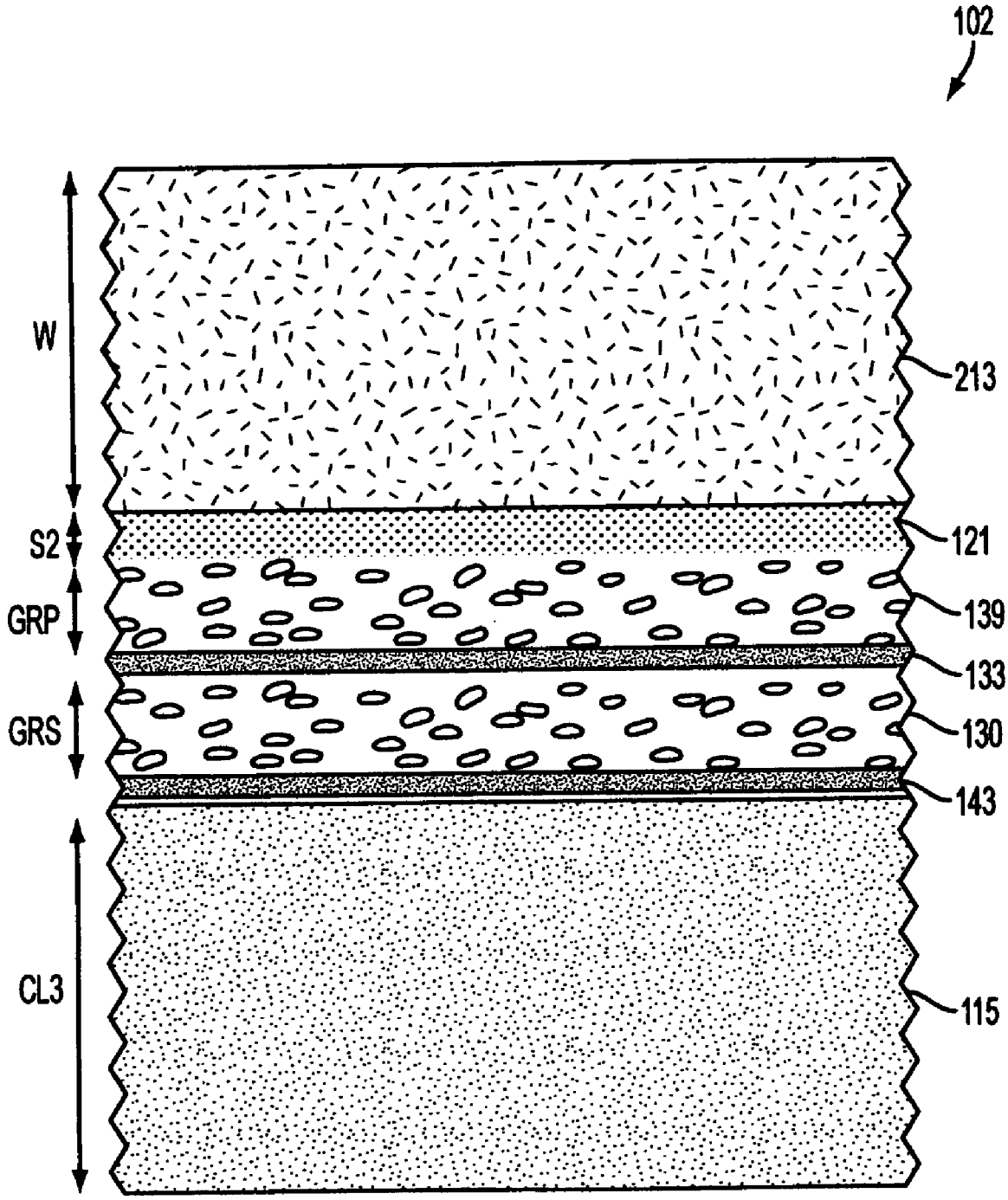
FIG. 2(*a*) shows an idealized cross-section of a conventional hazardous waste landfill minimum liner system comprising conventional primary and secondary geomembrane liners.
Figure 2B:
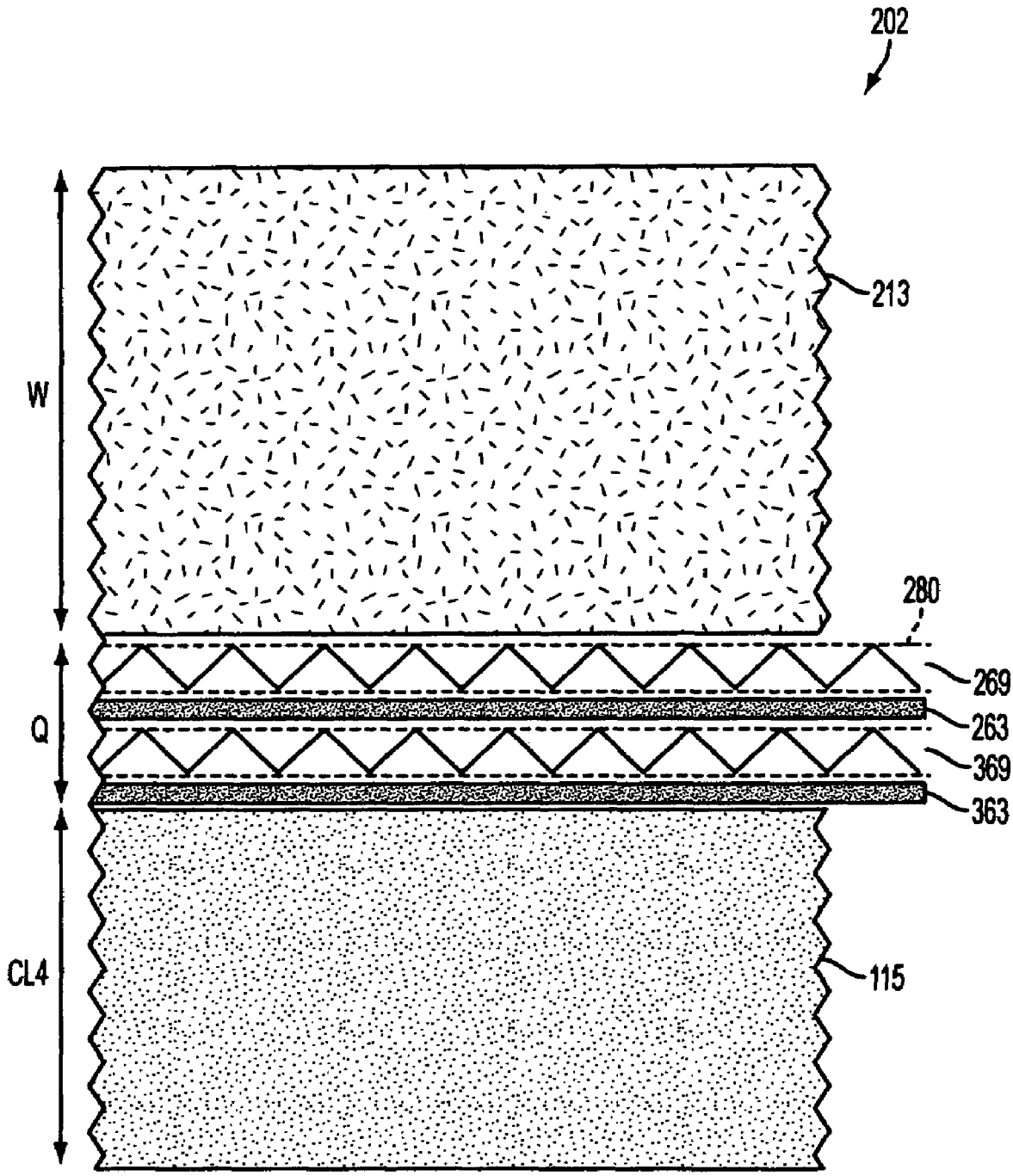

FIG. 2(*a*) shows an idealized cross section of a conventional hazardous waste landfill minimum liner system comprising conventional primary and secondary geomembrane liners. With reference to FIG. 2(*a*), clay base or liner 115, of thickness CL3, which is typically a minimum of 900 mm, is covered with conventional secondary geomembrane 143 as a secondary liner. Conventional secondary geomembrane 143 is covered with gravel layer 130, of thickness GRS, typically a minimum of 300 mm. Gravel layer 130 is in turn covered with primary geomembrane liner 133. Primary geomembrane liner 133 has gravel layer 139 disposed above it, of thickness GRP, typically a minimum of 300 millimeters. Conventional gravel layer 139 is covered with conventional sand layer 121, typically a minimum of 150 mm in thickness. On top of sand layer 121 is waste overburden 213, of thickness W, and typically of several meters to several dozen meters in thickness.

FIG. 2(*b*) shows an idealized cross-section of a hazardous waste landfill minimum liner system of the present invention including primary and secondary geocomposite/geomembrane liners. With respect to FIG. 2(*b*), an exemplary hazardous waste landfill minimum liner system 202 of the present invention shows how conventional sand and gravel layers, and conventional geomembrane liner layers, can be efficiently replaced with the present invention. Clay liner or base layer 115, of thickness CL4, and typically a minimum of 900 millimeters in thickness, is shown covered with secondary geomembrane liner 363, which is substantially impervious to fluids. On top of secondary liner 363 is void-maintaining geocomposite 369 which is constructed and arranged to provide egress of fluids draining through or from waste 213 and upwardly from clay liner 115 and the foundation beneath clay liner 115 (not shown). Void-maintaining geocomposite 369 also provides for the detection of leaks through membrane 263.

Geocomposite 369 has fluid-impermeable geomembrane layer 263 on top of it. In turn, geomembrane primary liner 263 is provided with geocomposite layer 269 having upper geotextile layer 280. Geotextile layer 280 is permeable to fluids, that is, gases or liquids draining from or through waste layer 213. Thus, primary geocomposite layer 269, primary geomembrane liner 263, secondary geocomposite layer 369 and secondary geomembrane liner 363 provide drainage and other egress of fluids attendant to waste layer 213. In total, the thickness Q of the combined thicknesses of geomembrane 363, void-maintaining geocomposite 369, membrane 263, geocomposite 269, and geotextile 200, is typically less than two inches, and more preferably, less than one inch.

Figure 3A:
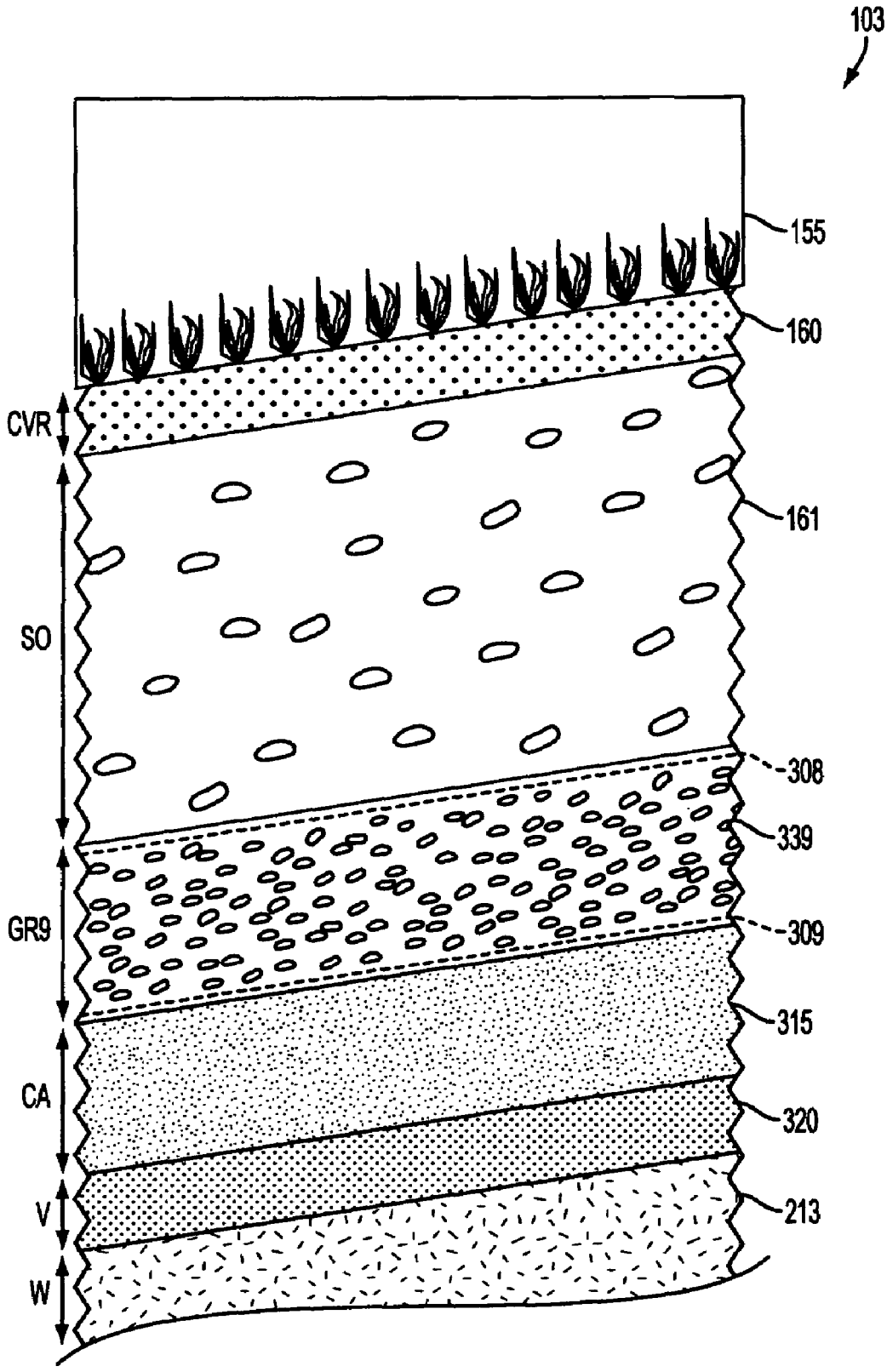
FIG. 3(*a*) shows an idealized cross-section of a typical conventional landfill cover system including gravel, cover soil, and top soil layers and conventional geotextiles.
Figure 3B:
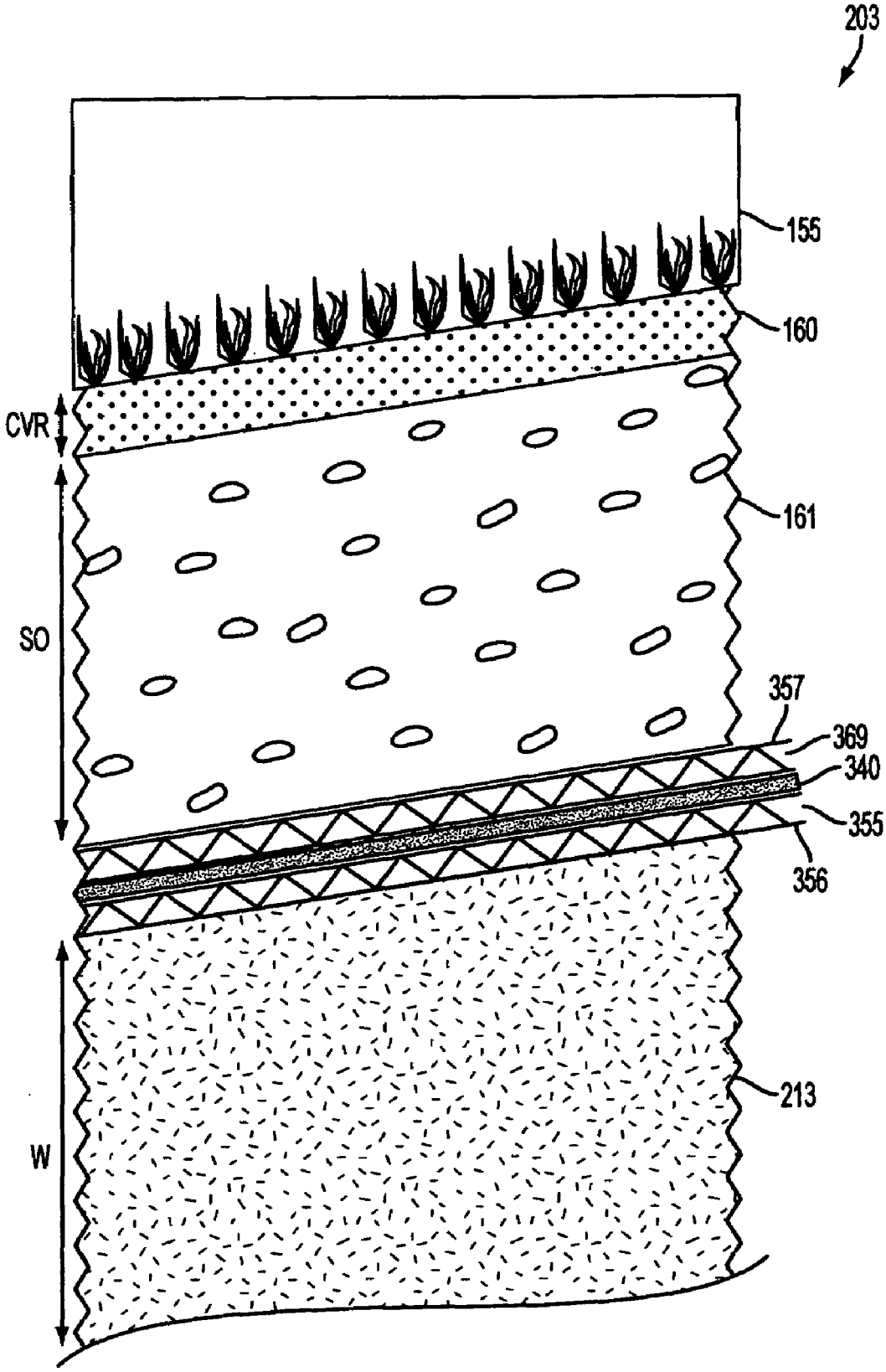

FIG. 3(*a*) shows an idealized cross-section of a typical conventional landfill cover, or capping, system including gravel, cover soil, top soil layers and conventional geotextiles. With reference to FIG. 3(*a*), typical landfill cover system 103 is shown on top of waste layer 213, of thickness W, which is typically a few meters or a few dozen meters in thickness. On top of waste layer 213 is provided gas venting layer 320, of thickness V, and typically of from 300 to 600 mm in thickness, capping clay layer 315, of thickness CA, and typically a minimum of 450 millimeters for hazardous waste landfills. Capping clay layer 315 is shown covered with conventional fluid-impermeable geomembrane layer 309. In turn, geomembrane layer 309 is covered with conventional gravel layer 339, of thickness GR9, and typically of from 100 to 300 millimeters in thickness, and typically covered by a conventional fluid-permeable geotextile, such as geotextile 308. Geotextile layer 308 is shown beneath cover soil layer 161. Cover soil layer 161 is of thickness SO, and is typically in the thickness range of from 200 to 1500 millimeters thick. Top soil layer 160 is provided above cover soils layer SO. Top soil layer 160, of thickness CVR, is typically of a minimum of 150 mm, and is provided with plants 155.

FIG. 3(*b*) shows an idealized cross-section of a typical landfill cover system of the present invention, including void-maintaining geocomposite elements for drainage and void-maintaining geocomposite elements for gas venting. With reference to FIG. 3(*b*), exemplary landfill cover system 203 according to the invention is shown as a capping structure for waste layer 213 of thickness W, and typically of several to several dozen meters thick. Above waste layer 213 is provided fluid-permeable bottom geotextile layer 356. On top of geotextile layer 356 is void-maintaining geocomposite gas venting element 355. Above void-maintaining geocomposite gas venting layer 355 is provided fluid-impermeable geomembrane 340 and void-maintaining geocomposite layer 369. On top of void-maintaining geocomposite layer 369 is shown fluid-permeable geotextile top layer 357 attached to geocomposite 369 at a plurality of points or areas. Cover soil layer 161 is shown above geotextile top layer 357. Cover soil layer 161 is of thickness SO, and typically of a thickness in the range of from 200 to 1500 millimeters. Top soil layer 160 is provided above cover soil layer SO. Top soil layer 160, of thickness CVR, and typically of a minimum of 150 millimeters, is provided with plants 155.

Thus, fluids draining through top soil layer 160 and cover soil layer 161 can drain through geotextile layer 357 into void-maintaining layer 369 and thus be substantially prevented from accumulating hydraulic pressure build-up. Such limitation of hydraulic pressure build-up is advantageous in that it restricts liquids from entering waste layer 213. Moreover, gases and other fluids which might make their way to the top of waste layer 213 are provided with paths for egress through geocomposite gas venting layer 355. On top of cover soil layer 161 is top soil layer 160, which is typically in a minimum thickness of 150 millimeters, and is preferably provided with plant overgrowth layer 155.

As one of skill in the art can appreciate, numerous permutations and variations of landfills, void-maintaining drainage elements, and combinations thereof are within the scope and spirit of the invention.

What is claimed is:

1. A synthetic drainable base course composite element suitable for providing drainage when positioned within a landfill, said base course element comprising a void-maintaining geocomposite, said geocomposite including a) a geocomposite core element having a plurality of ribs constructed and arranged to form a plurality of interconnected voids, said core element having an upper surface and a lower surface, a no-load thickness and a thickness under load, wherein said thicknesses are measured substantially perpendicular to said surfaces, and b) at least one fluid-transmissible layer attached adjacent said upper surface, wherein said layers and said core element are constructed and arranged so that, under a load of at least 1,000 lbs/foot$^2$ for a period of at least 100 hours, said geocomposite maintains voids of sufficient dimension that fluid from said landfill can move freely through portions of said drainage element at a transmissivity of at least 19 gallons/minute/foot at a slope gradient of 33% and at least 33 gallons/minute at a slope gradient of 10%, and wherein said geocomposite is constructed and arranged so that said transmissivity is maintained within said landfill when, fill comprising one or more layers, sections or quantities of waste or refuse materials, or waste or materials to be processed at least partially within said landfill, is disposed above said geocomposite, wherein at least a portion of said synthetic drainable base course is sloped downwardly in a gradient from a first portion to a second portion of said landfill.

2. A drainable landfill comprising

I. a base layer formed at least partially of one or more of native soil components and non-native soil components, II. a synthetic drainable base course element disposed above said base layer, said drainable base course element comprising A) a void-maintaining geocomposite, said geocomposite including i) a geocomposite core element having a plurality of ribs constructed and arranged to form a plurality of interconnected voids, said core element having an upper surface and a lower surface, a no-load thickness and a thickness under load, wherein said thicknesses are measured substantially perpendicular to said surfaces, and ii) at least one fluid-transmissible layer attached adjacent said upper surface, wherein said layers and said core element are constructed and arranged so that, under a load of at least 500 lbs/foot$^2$ for a period of at least 100 hours, said geocomposite maintains voids of sufficient dimension that fluid from said landfill can move freely through portions of said drainage element at a transmissivity of at least 19 gallons/minute/foot at a slope gradient of 33% and at least 33 gallons/minute at a slope gradient of 10%, and III. above said synthetic drainable base course, fill suitable to be drained, said fill comprising one or more layers, sections or quantities of refuse materials, or materials to be processed at least partially within said landfill, wherein at least a portion of said synthetic drainable base course is sloped downwardly in a gradient from a first portion to a second portion of said landfill.

3. The drainable landfill of claim 2, wherein said layers and said core element are constructed and arranged so that, under a load of at least 1,000 lbs/foot$^2$ for a period of at least 100 hours, said geocomposite maintains voids of sufficient dimension that fluid from said landfill can move freely through portions of said drainage element at a transmissivity of at least 19 gallons/minute/foot at a slope gradient of 33% and at least 33 gallons/minute at a slope gradient of 10%.

4. The drainable landfill of claim 2, wherein said layers and said core element are constructed and arranged so that, under a load of at least 15,000 lbs/foot$^2$ for a period of at least 100 hours, said geocomposite maintains voids of sufficient dimension that fluid from said landfill can move freely through portions of said drainage element at a transmissivity of at least 8.5 gallons/minute/foot at a slope gradient of 10%.

5. The drainable landfill of claim 2, wherein said layers and said core element are constructed and arranged so that, under a load of at least 25,000 lbs/foot$^2$ for a period of at least 100 hours, said geocomposite maintains voids of sufficient dimension that fluid from said landfill can move freely through portions of said drainage element at a transmissivity of at least 3.5 gallons/minute/foot at a slope gradient of 10%.

6. The drainable landfill of claim 2, wherein said core element comprises ribs constructed and arranged in a biplanar configuration.

7. The drainable landfill of claim 2, wherein said core element comprises ribs constructed and arranged in a triplanar configuration.

8. The drainable landfill of claim 2, wherein said core element comprises ribs constructed and arranged in a uniplanar configuration.

9. The drainable landfill of claim 2, wherein said non-native soil components are one or more selected from the group consisting of refuse from highway excavations, refuse from building foundation excavations, mining refuse, manufacturing refuse, geologic refuse, gypsum refuse, quarry refuse, refuse from road-building activities, and refuse from dredging operations.

10. The drainable landfill of claim 2, wherein said base layer of said drainable structure comprises at least one slope.

11. The drainable landfill of claim 2, wherein said base layer of said drainable landfill comprises a plurality of sloping surfaces.

12. The drainable landfill of claim 2, wherein said plurality of surfaces form at least one container.

13. The drainable landfill of claim 2, wherein said landfill comprises a plurality of containers.

14. The drainable landfill of claim 13, wherein said plurality of containers are constructed and arranged such that at least portions of one container can drain via gravitational means into one or more of other containers of said plurality of containers.

15. The drainable landfill of claim 2, wherein said drainage element further comprises iii) at least one frictional layer attached adjacent said lower surface of said geocomposite.

16. The drainable landfill of claim 2, wherein said drainage element further comprises iii) at least one cushion layer adjacent said lower surface of said geocomposite.

17. The drainable landfill of claim 2, wherein said landfill is layered.

18. The synthetic drainable base course (SDBC) of claim 2, wherein said ribs of said core are provided in a first set and a second set, and a) said ribs of said first set are disposed substantially parallel to one another and substantially in a first plane, and b) said ribs of said second set being disposed substantially parallel to one another and substantially in a second plane, and wherein said first and second planes are disposed adjacent one another.

19. The synthetic drainable base course of claim 18, wherein further ribs are provided in at least a third set wherein said ribs of said third set are disposed substantially parallel to one another and said third set of ribs is disposed in a third plane adjacent and non-parallel to the ribs of said first or second sets.

20. The synthetic drainable base course of claim 18, wherein the cross-section of any one of said ribs approximates one or more shapes from the group consisting of a square, a rectangle, an oval, a star shape, a crenulation, and a trapezoid.

21. The synthetic drainable base course of claim 20, wherein at least one of said ribs has the cross-section of a square and said square has a width and a height approximately equal to one another, and said width and said height have dimensions of from 1.0 mm to 10.0 mm.

22. The synthetic drainable base course of claim 20, wherein at least one of said ribs has the cross-section of a rectangle and said rectangle has a width and a height, and said width has dimensions of from 2.0 mm to 15.0 mm and said height has dimensions of from 1.0 mm to 10.0 mm.

23. The synthetic drainable base course of claim 20, wherein at least one of said ribs has the cross-section of a trapezoid and said trapezoid has a major width, a minor width and a height, and said major width has dimensions of from 2.0 mm to 15.0 mm, said minor width has dimensions of from 1.0 mm to 10.0 mm and said height has dimensions of from 1.0 mm to 10.0 mm.

24. The synthetic drainable base course of claim 2, wherein at least some of said ribs comprise crenulations and said crenulations are disposed longitudinally along the surfaces of said ribs.

25. The synthetic drainable base course of claim 2, wherein all of said ribs are crenulated and said crenulations are disposed longitudinally along the surfaces of said ribs.

26. The synthetic drainable base course of claim 2, wherein under a normal load of 1,200 kPa for at least 10,000 hours at 20 degrees Celsius, said thickness under load is at least 65% of said no-load thickness.

27. The synthetic drainable base course of claim 2, wherein under a normal load of 720 kPa for at least 5,000 hours at 40 degrees Celsius, said thickness under load is at least 65% of said no-load thickness.

28. The synthetic drainable base course of claim 2, wherein under a normal load of 1,200 kPa for at least 10,000 hours at 20 degrees Celsius, said thickness under load is at least 60% of said no-load thickness.

29. The synthetic drainable base course of claim 2, wherein under a normal load of 720 kPa for at least 5,000 hours at 40 degrees Celsius, said thickness under load is at least 60% of said no-load thickness.

30. The synthetic drainable base course of claim 2, wherein under a normal load of 1,200 kPa for at least 10,000 hours at 20 degrees Celsius, said thickness under load is at least 50% of said no-load thickness.

31. The synthetic drainable base course of claim 2, wherein under a normal load of 720 kPa for at least 5,000 hours at 40 degrees Celsius, said thickness under load is at least 50% of said no-load thickness.

32. The synthetic drainable base course of claim 2, wherein under a normal load of 720 kPa and a shear load of 240 kPa for at least 5,000 hours at 40 degrees Celsius, said thickness under load is at least 50% of said no-load thickness.

33. The synthetic drainable base course of claim 2, wherein under a normal load of 720 kPa and a shear load of 240 kPa for at least 5,000 hours at 40 degrees Celsius, said thickness under load is at least 45% of said no-load thickness.

34. The synthetic drainable base course of claim 2, wherein under a normal load of 720 kPa and a shear load of 240 kPa for at least 5,000 hours at 40 degrees Celsius, said thickness under load is at least 40% of said no-load thickness.

35. The synthetic drainable base course of claim 2, wherein said no-load thickness is in the range of from 0.20 inches to 1.00 inches.

36. The synthetic drainable base course of claim 2, wherein said no-load thickness is in the range of from 0.20 inches to 0.75 inches.

37. The synthetic drainable base course of claim 2, wherein said no-load thickness is in the range of from 0.25 inches to 0.35 inches.

38. The synthetic drainable base course of claim 2, wherein said core element is a machine manufactured network of fibers or filaments and has a tensile strength of at least 400 lbs per foot in the machine direction.

39. The synthetic drainable base course of claim 2, wherein said core element is a machine manufactured network of fibers or filaments and has a tensile strength of at least 500 lbs per foot in the machine direction.

40. The synthetic drainable base course of claim 2, wherein said gradient is at least 1% in a direction away from said portion of said landfill.

41. The synthetic drainable base course of claim 2, wherein said portion of said landfill is the centerline.

42. The synthetic drainable base course of claim 2, wherein under a load of 720 kPa for at least 100 hours, said voids maintain an average width of at least 2.0 mm and an average height of at least 10.0 mm.

43. The synthetic drainable base course of claim 2, wherein under a load of 720 kPa for at least 100 hours, said voids maintain an average width of from 2.0 mm to 10.0 mm.

44. The synthetic drainable base course of claim 2, wherein under a load of 720 kPa for at least 100 hours, said voids maintain an average width of from 3.0 mm to 8.0 mm.

45. The synthetic drainable base course of claim 2, wherein under a load of 1,200 kPa for at least 100 hours, said voids maintain an average width of from 2.0 mm to 10.0 mm.

46. The synthetic drainable base course of claim 2, wherein under a load of 1,200 kPa for at least 100 hours, said voids maintain an average width of from 3.0 mm to 8.0 mm.

47. The synthetic drainable base course of claim 2, wherein under a load of 1,200 kPa for at least 100 hours, said voids maintain an average height of from 2.0 mm to 10.0 mm.

48. The synthetic drainable base course of claim 2, wherein under a load of 1,200 kPa for at least 100 hours, said voids maintain an average height of from 3.0 mm to 8.0 mm.

49. The synthetic drainable base course of claim 2, wherein under a load of 720 kPa for at least 100 hours, said voids maintain an average width of at least 3.0 mm and an average height of at least 10.0 mm.

50. The synthetic drainable base course of claim 2, wherein under a load of 1,200 kPa for at least 100 hours, said voids maintain an average width of at least 2.0 mm and an average height of at least 8.0 mm.

51. The synthetic drainable base course of claim 2, wherein under a load of 720 kPa for at least 100 hours, said voids maintain an average width of at least 6.0 mm and an average height of at least 8.0 mm.

52. The synthetic drainable base course of claim 2, wherein under a load of 1,200 kPa for at least 1,000 hours, said voids maintain an average width of at least 2.0 mm and an average height of at least 8.0 mm.

53. The synthetic drainable base course of claim 2, wherein under a load of 720 kPa for at least 1,000 hours, said voids maintain an average width of at least 6.0 mm and an average height of at least 8.0 mm.

54. The synthetic drainable base course of claim 2, wherein said ribs are constructed and arranged to form preferential flow paths and non-preferential flow paths in a sloped portion of said landfill.

55. The synthetic drainable base course of claim 54, wherein said preferential flow paths and said non-preferential flow paths are not parallel to one another and are formed by said ribs.

56. The synthetic drainable base course of claim 54, disposed in a landfill such that said preferential flow paths are substantially perpendicular to said portion of said landfill.

57. The synthetic drainable base course of claim 54, disposed in a landfill such that said preferential flow paths are substantially parallel to said portion of said landfill.

58. The synthetic drainable base course of claim 54, wherein at least 35% of the volume of fluid moving through said SDBC does so by way of said preferential flow paths.

59. The synthetic drainable base course of claim 54, wherein at least 50% of the volume of fluid moving through said SDBC does so by way of said preferential flow paths.

60. The synthetic drainable base course of claim 54, wherein at least 65% of the volume of fluid moving through said SDBC does so by way of said preferential flow paths.

61. The synthetic drainable base course of claim 54, wherein said portion of said landfill is the centerline or axis of at least one of said first and second portions of said landfill.

62. The synthetic drainable base course of claim 1, wherein said geocomposite core comprises at least one margin constructed and arranged to transmit fluids from said base course away from said landfill.

63. The synthetic drainable base course of claim 62, wherein said at least one margin is constructed and arranged to connect with one or more selected from the group consisting of perforated pipes, non-perforated pipes, drainage ditches, sumps, canals, re-circulating manifolds, drainage manifolds and facilities for further processing of said fluid.

64. A method of forming drainable landfill, comprising the steps of

I. providing a base layer formed at least partially of one or more of native soil components and non-native soil components, II. providing a synthetic drainable base course element disposed above said base layer, said drainage element comprising A) a void-maintaining geocomposite, said geocomposite including i) a geocomposite core element having a plurality of ribs constructed and arranged to form a plurality of interconnected voids, said core element having an upper surface and a lower surface, a no-load thickness and a thickness under load, wherein said thicknesses are measured substantially perpendicular to said surfaces, and ii) at least one fluid-transmissible layer attached adjacent said upper surface, wherein said layers and said core element are constructed and arranged so that, under a load of at least 500 lbs/foot$^2$ for a period of at least 100 hours, said geocomposite maintains voids of sufficient dimension that fluid from said landfill can move freely through portions of said drainage element at a transmissivity of at least 19 gallons/minute/foot at a slope gradient of 33% and at least 33 gallons/minute at a slope gradient of 10%, and III. providing above said synthetic drainable base course, fill suitable to be drained, said fill comprising one or more layers, sections or quantities of refuse materials, or materials to be processed at least partially within said landfill, wherein at least a portion of said synthetic drainable base course is sloped downwardly in a gradient from a first portion to a second portion of said landfill.

65. The method of claim 64, wherein said non-native soil components are one or more selected from the group consisting of refuse from highway excavations, refuse from building foundation excavations, mining refuse, manufacturing refuse, geologic refuse, gypsum refuse, quarry refuse, refuse from road-building activities, and refuse from dredging operations.

66. The method of claim 64, wherein said base layer of said drainable structure comprises at least one slope.

67. The method of claim 64, wherein said drainage element of said drainable landfill further comprises iii) at least one frictional layer attached adjacent said lower surface of said geocomposite.

68. The method of claim 64, wherein said drainage element of said drainable landfill further comprises iii) at least one cushion layer adjacent said lower surface of said geocomposite.

69. The method of claim 64, wherein said landfill is layered.

70. The method of claim 64, wherein said ribs of said core are provided in a first set and a second set, and a) said ribs of said first set are disposed substantially parallel to one another and substantially in a first plane, and b) said ribs of said second set being disposed substantially parallel to one another and substantially in a second plane, and wherein said first and second planes are disposed adjacent one another.

71. The method of claim 64, wherein further ribs are provided in at least a third set wherein said ribs of said third set are disposed substantially parallel to one another and said third set of ribs is disposed in a third plane adjacent and non-parallel to the ribs of said first or second sets.

72. The method of claim 64, wherein the cross-section of any one of said ribs approximates one or more shapes from the group consisting of squares, rectangles, ovals, star shapes, crenulations, and trapezoids.

73. The method of claim 64, wherein said layers and said core element are constructed and arranged so that, under a load of at least 1,000 lbs/foot$^2$ for a period of at least 100 hours, said geocomposite maintains voids of sufficient dimension that fluid from said landfill can move freely through portions of said drainage element at a transmissivity of at least 19 gallons/minute/foot at a slope gradient of 33% and at least 33 gallons/minute at a slope gradient of 10%.

74. The method of claim 64, wherein said layers and said core element are constructed and arranged so that, under a load of at least 15,000 lbs/foot$^2$ for a period of at least 100 hours, said geocomposite maintains voids of sufficient dimension that fluid from said landfill can move freely through portions of said drainage element at a transmissivity of at least 8.5 gallons/minute/foot at a slope gradient of 10%.

75. The method of claim 64, wherein said layers and said core element are constructed and arranged so that, under a load of at least 25,000 lbs/foot$^2$ for a period of at least 100 hours, said geocomposite maintains voids of sufficient dimension that fluid from said landfill can move freely through portions of said drainage element at a transmissivity of at least 3.5 gallons/minute/foot at a slope gradient of 10%.

* * * * *